United States Patent [19]

Nishimura

[11] 4,420,144

[45] Dec. 13, 1983

[54] MANUAL HOISTING AND PULLING APPARATUS

[75] Inventor: Koji Nishimura, Rittocho, Japan

[73] Assignee: Vital Kogyo Kabushiki Kaisha, Osaka, Japan

[21] Appl. No.: 310,839

[22] Filed: Oct. 13, 1981

[30] Foreign Application Priority Data

Oct. 21, 1980 [JP] Japan ..... 55-147956
Dec. 25, 1980 [JP] Japan ..... 55-188828

[51] Int. Cl.[3] ..... B66D 1/04

[52] U.S. Cl. ..... 254/345; 254/350; 254/353; 254/357

[58] Field of Search ..... 254/345, 350, 354, 353, 254/352, 357, 298, 304, 308, 307, 306, 310, 217-219, 221, 223

[56] References Cited

U.S. PATENT DOCUMENTS 148,605 3/1874 Gardner ..... 254/345
989,430 4/1911 Sasgen ..... 254/345
3,047,114 7/1962 Stevens ..... 254/350 X
4,251,060 2/1981 Suzuki et al. ..... 254/345

FOREIGN PATENT DOCUMENTS 1017569 10/1957 Fed. Rep. of Germany ..... 254/345

*Primary Examiner*—John M. Jillions
*Attorney, Agent, or Firm*—Holman & Stern

[57] ABSTRACT

A hand hoist or pulling apparatus including a drive clutch assembly, and a drive shaft and transmission gears associated with the assembly for pulling a chain on a load sheave by oscillating a lever. A holding member and a stop lever for preventing the member from movement are provided to hold a pinion on one end of the drive shaft in meshing engagement with the transmission gears and also to hold the pinion disengaged therefrom when the drive shaft is shifted. The holding member is held stationary against rotation, mounted on the clutch assembly and restrained from axial movement by the stop lever which is biased by a spring and pivotally mounted on a side plate.

6 Claims, 5 Drawing Figures

MANUAL HOISTING AND PULLING APPARATUS

BACKGROUND OF THE INVENTION

1. Field of the Invention

The present invention relates to a manual pulling apparatus which is useful also as a hoist and which is driven manually in the same manner as chain blocks for pulling a load chain to draw a package fastening rope or for lifting a heavy article.

2. Description of the Prior Art

With known pulling of hand hoist apparatus, a load sheave driving pinion fixedly mounted on a drive shaft is adapted to be held in meshing engagement with intermediate gears by being pressed on a side portion thereof with a spring. When the pinion is disengaged from the intermediate gears, the load sheave is freely rotatable, whereby a chain can be paid off from the load sheave free of resistance to reach the article to be pulled along. However, to move the pinion axially thereof out of engagement with the intermediate gears, a hand wheel fixedly mounted on the drive shaft must be pulled toward the user with a considerably great force against the action of the spring. See, for example, Japanese Pat. No. 728,097.

Thus, with the known hoist apparatus described, the load sheave driving pinion is held in meshing engagement with the intermediate gears only by the pressing force of the spring. Accordingly when the spring becomes fatigued or the intermediate gears are worn, the drive shaft tends to retract while the pinion is in rotation, with the resulting likelihood that the pinion will disengage from the intermediate gears.

The conventional hoist apparatus of the type described further has a ratchet wheel provided between the friction plates of a brake assembly and a reverse rotation preventing pawl engaging the ratchet wheel and supported by a pin on one of the side plates for holding the load sheave. Consequently when the load sheave is heavily loaded, the opposed side plates are likely to deform inward toward each other at their center portions where the side plates are not connected together by stay bolts to maintain a specified distance therebetween. The deformation of the side plates will alter the posture of the pin projecting from one of the side plates and also the posture of the reverse rotation preventing pawl which is mounted on the pin so as to act on the ratchet wheel. The pawl is then liable to disengage from the ratchet wheel.

SUMMARY OF THE INVENTION

The main object of the present invention is to provide a hand manual pulling apparatus of novel construction which is serviceable also as a hand hoist and which is free of the above drawbacks.

According to the present invention, a load sheave driving pinion is engageable with and disengageable from intermediate gears properly with safety while a drive clutch assembly of the friction type is maintained in its initially adjusted state, so that the apparatus functions properly as intended. After an article has been pulled along, a length of load chain required for pulling the next article can be paid off from the load sheave rapidly with ease by the idle rotation of the sheave. The apparatus therefore achieves an improved work efficiency.

Further according to the present invention, a reverse rotation preventing pawl is maintained in proper engagement with a ratchet wheel provided between the friction plates of a brake assembly, even when the opposite side plates for supporting the load sheave are deformed inward toward each other by a load acting on the apparatus during operation.

DESCRIPTION OF THE PREFERRED EMBODIMENT

Figure 1:
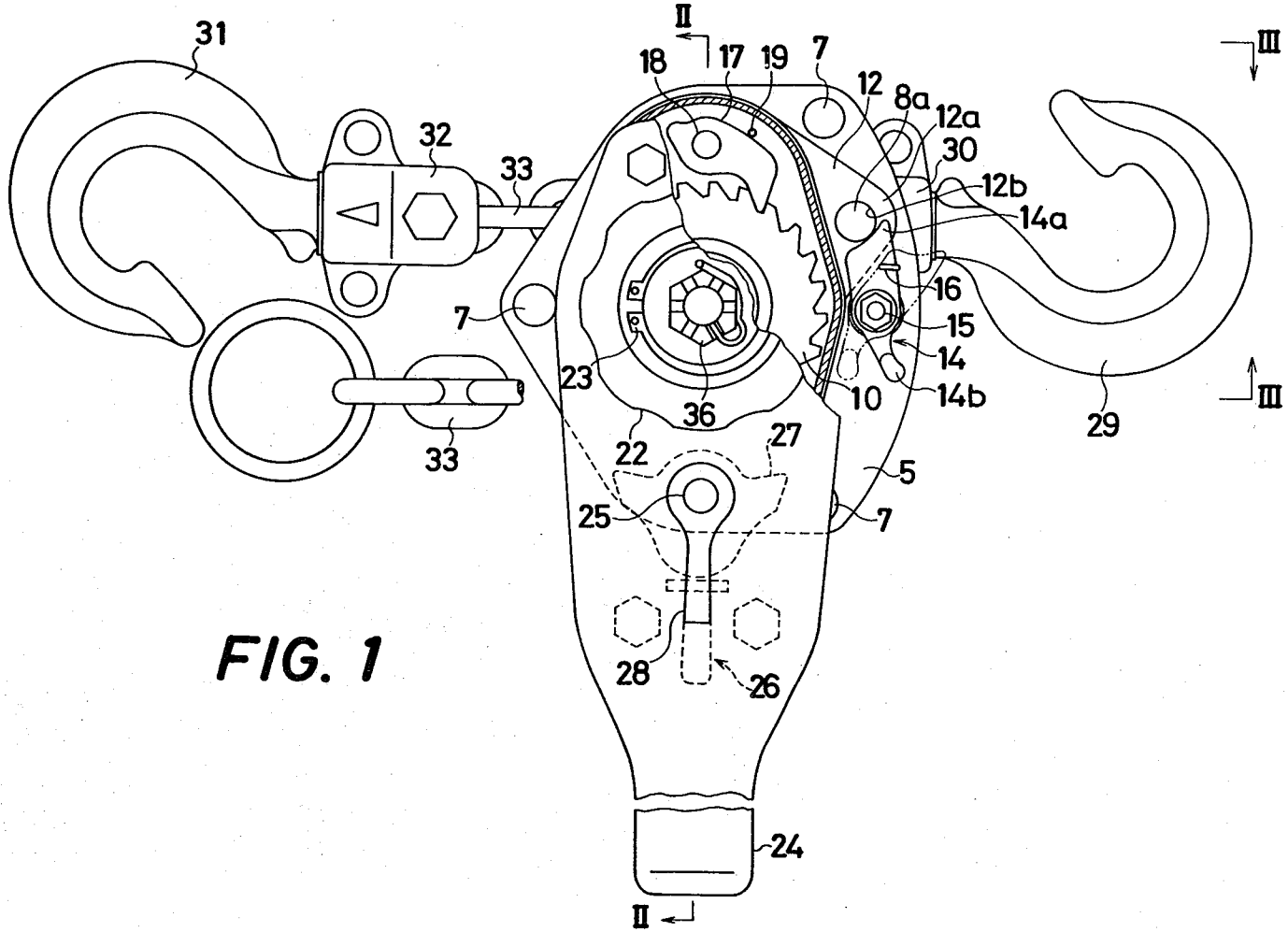
FIG. 1 is a front elvational view partly broken away showing an embodiment of the invention.
Figure 2:
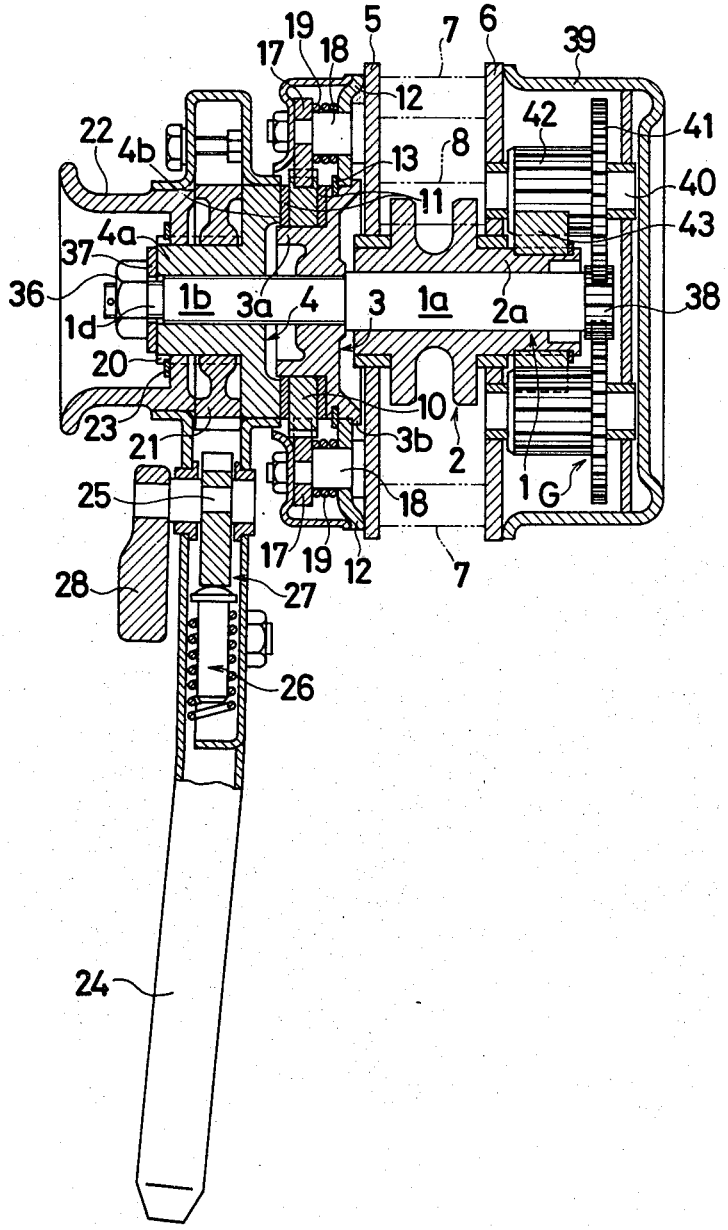
FIG. 2 is a cross-sectional view section taken along the line II—II in FIG. 1.

With reference to FIG. 2, a drive shaft 1 supported by a load sheave 2 includes a portion 1*a* which is rotatably supported by the sheave 2 and a helically threaded portion 1*b* which is provided, in screw-thread engagement therewith, with a driven member 3 and a drive member 4 on the left side of the member 3. A pair of side plates 5, 6 for supporting the load sheave 2 are held spaced apart by a specified distance with stay bolts 7. A hook 29 is connected to the right portions of the side plates 5, 6 shown in FIG. 1 by a connecting rod 8 provided between and attached to the side plates 5, 6 and also by a connector 30.

Torque is delivered from the drive shaft 1 to the load sheave 2 which is rotatable relative to the shaft, through a train of transmission gears, G, which is disposed on the right side of the side plate 6 as shown in FIG. 2. The transmission gear train G, which is known, comprises a drive pinion 38 fixedly mounted on the right end of the portion 1*a* of the drive shaft 1, intermediate gears 41 meshing with the pinion 38, mounted on shafts 40 and disposed between the side plate 6 and a gear cover 39, a second intermediate gear 42 integral with each of the gears 41, and a load gear 43 meshing with the second intermediate gears 42 and fixed to a right boss portion 2*a* of the sheave 2.

The driven member 3 is screwed on the threaded portion 1*b* of the drive shaft 1, with a right-side boss portion of the member 3 in contact with the left end face of the shaft portion 1*a*. The driven member 3 has a boss portion 3*a* supporting thereon a ratchet wheel 10 and friction plates 11, 11 on the opposite sides of the ratchet wheel 10. The ratchet wheel 10 and the friction plates 11, 11 in combination therewith are pressed against each other or relieved of the pressure around the driven member 3, by an annular side face 4*b* of the drive member 4 which is screwed on the left part of the threaded portion 1*b* of the drive shaft 1. A drive gear 21 is splined as at 20 to a boss portion 4*a* of the drive member 4. As already known, the gear 21 is intermittently driven in a driving direction or opposite direction by a known rotational direction change pawl 27 which is biased by a resilient pressing member 26 housed in an operating lever 24.

The direction of rotation is changed by a knob 28 connected to the pawl 27.

A hand wheel 22 is splined as at 20 to the left end of the boss portion 4*a* of the drive member 4 and is in contact with the left side of the drive gear 21. The wheel 22 is retained in position by a snap ring 23. The threaded portion 1*b* has a screw portion 1*d* extending from its left end and having a smaller diameter. A nut 36 is screwed on the screw portion 1*d* with a washer 37 interposed between the nut 36 and the left end of the boss portion 4*a*. This left end is opposed to the washer 37 as spaced therefrom by a small distance. The term "drive clutch assembly" as used in this specification refers to the combination of the driven member 3 and the drive member 4 which are screwed on the threaded portion 1*b* of the drive shaft 1 as already described. When the clutch assembly is set in position, the specified distance is provided between the left end of the drive member boss portion 4*a* and the washer 37.

The hand hoist apparatus of the invention described above further includes a drive shaft holding member 12 which is rotatably mounted on a portion of the driven member 3. More specifically the holding member 12 is mounted on the driven member 3 axially fixed but rotatable relative thereto by a flange 3*b* formed on the outer periphery of the member 3 at one side thereof and by a snap ring 13. The holding member 12 has a triangular projection 12*a* formed with a hole 12*b*. A stopper pin 8*a* projecting from the side plate 5 is slidably fitted in the hole 12*b*. In the illustrated embodiment, the stopper pin 8*a* is an extension of the connecting rod 8.

Disposed adjacent to the triangular projection 12*a* is an axial movement stop member 14 which is rotatably mounted on a pin 15 on the side plate 5. The stop member 14 is biased by a spring 16 toward the stopper pin 8*a* so that an acting end 14*a* thereof will bear against the stopper pin 8*a*.

Figure 3:
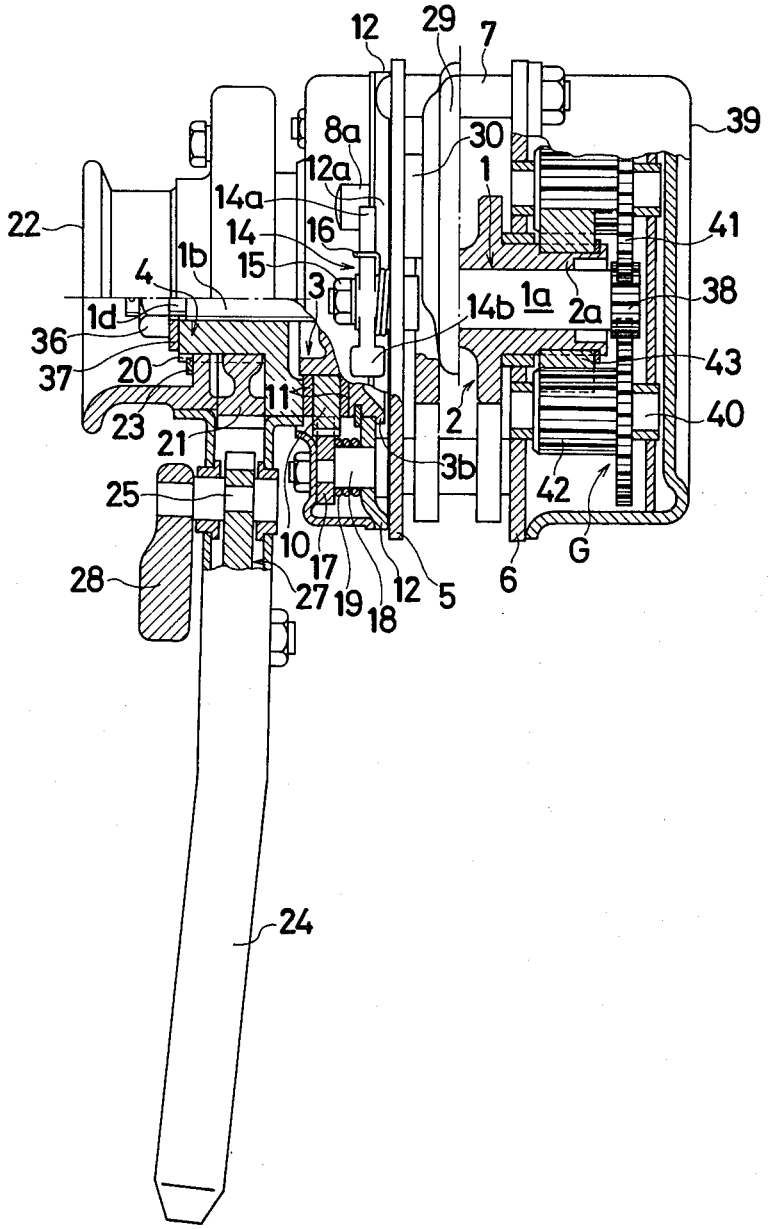
FIG. 3 is a side elevational and partly cross-sectional view similar to FIG. 2 taken along the line III—III in FIG. 1.

While the drive pinion 38 on the drive shaft 1 is in engagement with the intermediate gears 41, 41, the stop member 14 overlaps the projection 12*a* of the holding member 12 as seen in FIG. 1, with the right side of the member 14 (as seen in FIG. 3) fitting over part of the outer side (i.e. left side in FIG. 3) of the projection 12*a*, whereby the drive shaft 1 is prevented from moving leftward (in FIG. 3) to hold the pinion 38 in engagement with the intermediate gears 41, 41.

Figure 4:
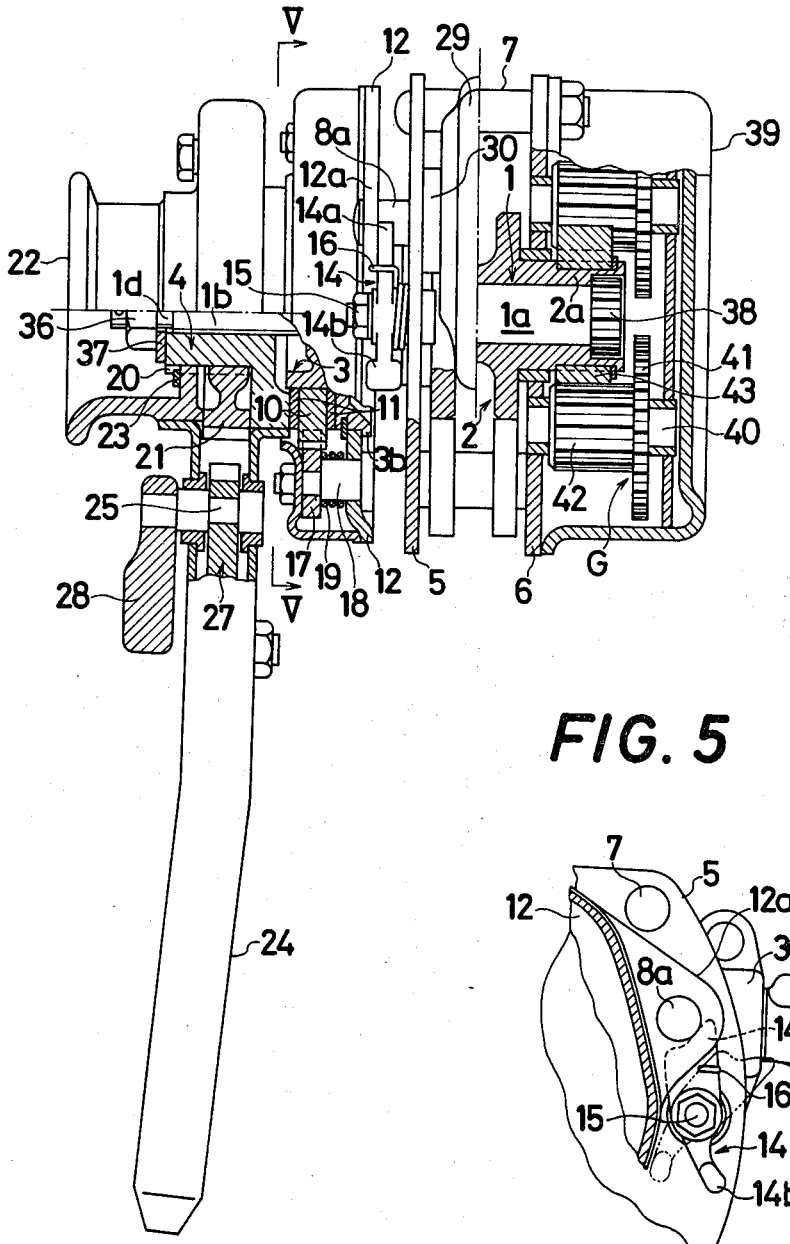
FIG. 4 is a side elevational and partly cross-sectional view similar similar to FIG. 3 and showing a drive shaft as pulled outward by a hand wheel from the position of FIG. 3.
Figure 5:
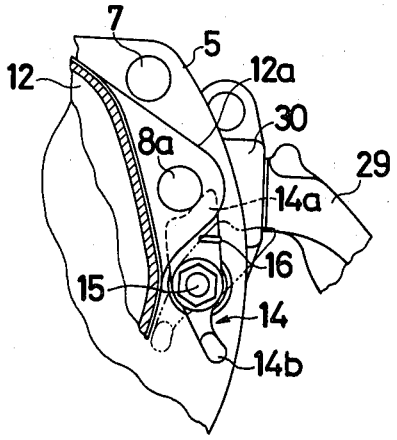
FIG. 5 is a front view of a holding member as it is seen when viewed along the line V—V in FIG. 4.

On the other hand, the stop member 14 is rotatable about the pin 15 to a position indicated in a broken line in FIG. 1 against the action of the spring 16 by moving a manipulating end 14*b* of the member 14. When the member 14 is thus turned, the drive shaft 1 is movable leftward by the hand wheel 22 to disengage the pinion 38 from the intermediate gears 41, 41 as seen in FIG. 4. When the stop member 14 is then freed, the member 14 returns and comes into contact with the stopper pin 8*a*, with the left side of the member 14 overlapping the right side of the projection 12*a* of the holding member 12. This prevents the drive shaft 1 from moving rightward, holding the pinion 38 out of engagement with the intermediate gears 41, 41.

Known reverse rotation preventing pawls 17 are each mounted on the holding member 12 by a pin 18. By being biased by a spring 19 wound on the pin 18, the pawl 17 acts on the ratchet wheel 10 clamped between the friction plates 11 on the driven member 3 to prevent the driven member 3 and, therefore, the drive shaft 1 from rotating in a reverse direction during the operation of the apparatus. Thus the pawls 17 perform the known function.

The pinion 38 is held in meshing engagement with the intermediate gears 41, 41 by the holding member 12 being prevented from shifting leftward by the right side face of the preventing member 14 as seen in FIG. 3. Thus, the drive shaft 1 is held in the position of FIG. 3 against axial movement by the driven member 3 which is screwed on the drive shaft 1 and held in position by the holding member 12 against axial movement. The operating lever 24, when repeatedly moved pivotally in this state, rotates the drive gear 21 in one direction which is determined by which of the two pawl portions of the change pawl 27 is in engagement with the gear 21.

The rotation of the drive gear 21 in the driving direction is delivered through the splined portion 20 to the drive member 4 and advances the drive member 4 rightward on the threaded portion 1*b*, pressing the combination of friction plates 11 and ratchet wheel 10. Consequently the driven member 3 is driven. The integral rotation of the clutch assembly is delivered from the drive shaft 1 to the pinion 38 to cause the train of transmission gears to rotate the load sheave 2, so that a load chain 33 on the sheave 2 hoists or pulls a load. During this operation, the pawls 17 mounted on the holding member 12 by the pins 18 act to prevent the reverse rotation of the ratchet wheel 10 on the driven member 3 rotating with the shaft 1, consequently preventing the reverse rotation of the drive shaft 1.

When the change pawl 27 acts in a direction opposite to the above to rotate the drive gear 21 in the opposite direction, the drive member 4 slightly moves leftward to release the friction plates 11 and ratchet wheel 10 from clamping engagement, thus rendering the drive shaft 1 free to reversely rotate slightly. This operation is already known and therefore will not be described in detail.

After a load has been pulled along, there arises the need to render the load sheave rotatable as an idler to pay off the load chain rapidly for connection to the next load. To disengage the pinion 38 from the gears 41 for this purpose, the manipulating end 14*b* of the stop member 14 is turned by one hand about the pin 15 against the action of the spring 16 to bring the member 14 to the broken-line position of FIG. 1. With the stop member 14 thus moved out of lapping engagement with the holding member 12, the hand wheel 22 is pulled leftward by the other hand, thereby moving the drive shaft 1 leftward along with the driven member 3, drive member 4, drive gear 21, etc. When the pinion 38 on the drive shaft 1 is moved away from the intermediate gears 41, the holding member 12 is shifted to the left side of the stop member 14. In this position, the stop member 14 is released from the hand, whereupon the member 14 is forced into contact with the stopper pin 8*a* by the spring 16, with the left side of the member 14 brought into engagement with the holding member 12, to prevent the pinion 38 from moving into meshing engagement with the intermediate gears 41.

When one portion of the load chain 33 reeved around the sheave 2 is pulled in this state, the sheave 2, which is released from the gear train G, easily rotates. Accordingly the desired length of the load chain 33 can be paid off freely, with a small force and within a short period of time.

Whether the pinion 38 is in engagement with the intermediate gears 41 or not can be recognized easily depending on whether the stop member 14 is in engagement with the outer side (left side) or with the inner side (right side) of the holding member 12, while the member 14 can be held so engaged reliably. Thus the apparatus is usable with enhanced safety. Further since no spring is used for pressing on a side portion of the pinion 38 to hold the pinion 38 in engagement with the intermediate gears 41, the pinion 38 is disengageable by pulling the hand wheel 22 by a very small force.

The present invention has another advantage. The apparatus will be used with the right hook 29 engaged with a fixed structure and a left hook 31 engaged with a package to pull the package toward the apparatus by operating the lever 24 (see FIG. 1). In this case, the side plates 5, 6 which are held spaced apart by the stay bolts 7 are subjected to a bending moment between the connecting rod 8 for the hook 29 and the boss portion 2*a* of the load sheave 2 by virtue of the great load to be pulled, with the result that the side plates 5, 6 are bent inward toward each other at their center portions.

According to the present invention, the holding member 12 rotatably mounted on the driven member 3 is separate from the side plate 5 and therefore remains free of any bending even when the side plate 5 is bent as above. Since the reverse rotation preventing pawls 17 are supported on the pins 18 fixed to the holding member 12, the pawls 17 are properly held engaged with the ratchet wheel 10 at all times to act in one direction and thereby prevent the reverse rotation of the drive shaft 1 even when the apparatus is subjected to an excess of load. This assures greatly improved safety in pulling operations.

What is claimed is:

1. In a hand hoist including a load sheave disposed between a pair of side plates and supported on a drive shaft, an operating lever associated with one end of the drive shaft to rotate said shaft, a drive member and a driven member provided between the operating lever and one of the side plates and screwed on a threaded portion of the drive shaft, a reverse rotation preventing assembly provided between the drive member and the driven member, and a train of transmission gears provided between the other end of the drive shaft and the load sheave including an axially movable pinion on said drive shaft removably engageable with intermediate gears, the improvement comprising a drive shaft holding member rotatably mounted on the driven member so that it is axially movable with the driven member and substantially non-rotatable irrespective of rotation of the driven member, and a stop member mounted on said one of the side plates and movable to selectively overlap opposite sides of said holding member to retain the pinion on the other end of the drive shaft engaged with or disengaged from the intermediate gears.

2. A hand hoist as defined in claim 1 and further comprising a stopper pin projecting from said one of the side plates, and a hole through said holding member is provided slidably receiving said stopper pin.

3. A hand hoist as defined in claim 1 wherein said stop member is pivotally mounted on said one said one side plate and biased by a spring acting between said stop member and one side plate so that said stop member is resiliently urged into said overlapping positions, and a projection on said holding member engageable by said stop member in said overlapping positions.

4. A hand hoist as defined in claim 2 wherein said stop member has an acting end engageable in a stopping position with said stopper pin.

5. A hand hoist as defined in claim 4 wherein said stop member has on the other end thereof a manipulating means.

6. A hand hoist as defined in claim 1 wherein said reverse rotation preventing assembly comprises a pawl pivotally mounted on said holding member operably engaging a ratchet wheel mounted on said driven member, friction plates mounted on said driven member on opposite sides of said ratchet wheel and means to clamp said ratchet wheel between said friction plates during use.

* * * * *